US009045702B2

(12) United States Patent
Hirohashi et al.

(10) Patent No.: US 9,045,702 B2
(45) Date of Patent: Jun. 2, 2015

(54) METHOD FOR PRODUCING LUBRICANT BASE OIL

(75) Inventors: Chikako Hirohashi, Tokyo (JP); Yuichi Tanaka, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 76 days.

(21) Appl. No.: 13/146,700

(22) PCT Filed: Mar. 8, 2010

(86) PCT No.: PCT/JP2010/053782

§ 371 (c)(1),
(2), (4) Date: Jul. 28, 2011

(87) PCT Pub. No.: WO2010/113599

PCT Pub. Date: Oct. 7, 2010

(65) Prior Publication Data

US 2012/0037539 A1 Feb. 16, 2012

(30) Foreign Application Priority Data

Mar. 31, 2009 (JP) ..... 2009-087176

(51) Int. Cl.

| | |
|---|---|
| ***C10G 45/64*** | (2006.01) |
| ***C10G 45/60*** | (2006.01) |
| ***C10G 73/06*** | (2006.01) |
| ***C10G 45/58*** | (2006.01) |
| ***C10G 21/00*** | (2006.01) |
| ***C10G 45/62*** | (2006.01) |
| ***C10G 67/04*** | (2006.01) |

(52) U.S. Cl.

CPC ..... *C10G 45/58* (2013.01); *C10G 21/003* (2013.01); *C10G 45/60* (2013.01); *C10G 45/62* (2013.01); *C10G 67/0454* (2013.01); *C10G 2300/1022* (2013.01); *C10G 2300/301* (2013.01); *C10G 2300/302* (2013.01); *C10G 2300/304* (2013.01); *C10G 2400/10* (2013.01)

(58) Field of Classification Search

CPC ..... C10G 21/003; C10G 2300/1022; C10G 2300/301; C10G 2300/302; C10G 2300/304; C10G 2400/10; C10G 45/58; C10G 45/60; C10G 45/62; C10G 67/0454

USPC ..... 208/24, 28, 33, 46, 133, 134, 141, 308, 208/311, 318, 950; 518/724

See application file for complete search history.

(56) References Cited

U.S. PATENT DOCUMENTS

| | | | | |
|---|---|---|---|---|
| 5,059,299 | A * | 10/1991 | Cody et al. | 208/27 |
| 6,096,940 | A | 8/2000 | Wittenbrink et al. | |
| 6,562,230 | B1 * | 5/2003 | O'Rear et al. | 208/66 |
| 7,132,042 | B2 | 11/2006 | Genetti et al. | |
| 2004/0045868 | A1 | 3/2004 | Germaine | |
| 2004/0079675 | A1 | 4/2004 | Germaine | |
| 2004/0099571 | A1 | 5/2004 | Germaine | |
| 2007/0272592 | A1 | 11/2007 | Germaine et al. | |
| 2009/0159492 | A1 | 6/2009 | Duhoux et al. | |

FOREIGN PATENT DOCUMENTS

| | | |
|---|---|---|
| CA | 2 320 106 | 8/1999 |
| CN | 1047687 | 12/1990 |
| CN | 1181166 | 12/2004 |
| CN | 101044226 | 9/2007 |
| JP | 4-35391 | 2/1992 |
| JP | 04-36391 | 2/1992 |
| JP | 4-68082 | 3/1992 |
| JP | 4-120193 | 4/1992 |
| JP | 2000-502135 | 2/2000 |
| JP | 2002-503754 | 2/2002 |
| JP | 2005-154760 | 6/2005 |
| JP | 2006-502298 | 1/2006 |
| RU | 2268286 | 1/2006 |
| WO | 2008/055976 | 5/2008 |

OTHER PUBLICATIONS

Gary, J, Petroleum Refining: Technology and Economics, 1994, pp. 305-320.*

Fujita, "Junkatsuyu Kiyu Seizo . . . ", Journal of Economic Maintenance Tribiology, 2003, pp. 40-47.

Search report from Interantional Application No. PCT/JP2010/053782, mail date is Mar. 30, 2010.

International Preliminary Report on Patentability for PCT/JP2010/053782, mailed Nov. 15, 2011.

Office Action for counterpart Chinese Patent Application No. 201080014848.X, mailed on Jun. 20, 2013.

Russia Office action for RU Patent Application No. 2011143807, mail date is Sep. 19, 2013.

Chinese Office Action in regards to Chinese Application No. 201080014848.X, dated Jun. 13, 2014.

* cited by examiner

*Primary Examiner* — Walter D Griffin
*Assistant Examiner* — Derek Mueller
(74) *Attorney, Agent, or Firm* — Greenblum & Bernstein, P.L.C.

(57) ABSTRACT

A process for production of a lubricating base oil whereby a lubricating base oil is obtained by a first step in which a stock oil containing normal paraffins of $C_{20}$ or more is subjected to isomerization reaction so that the content of the normal paraffins of $C_{20}$ or more is 6-20 wt % based on the total weight of hydrocarbons of $C_{20}$ or more in the obtained reaction product, a second step in which a lube-oil fraction containing hydrocarbons of $C_{20}$ or more is separated from the reaction product of the first step, and a third step in which the lube-oil fraction obtained in the second step is separated into a dewaxed oil and a wax by a solvent dewaxing treatment.

8 Claims, No Drawings

METHOD FOR PRODUCING LUBRICANT BASE OIL

TECHNICAL FIELD

The present invention relates to a process for production of a lubricating base oil.

BACKGROUND ART

In the field of lubricating oils, additives such as pour point depressants have conventionally been added to lubricating base oils including highly refined mineral oils, to improve the cold properties of the lubricating oils (see Patent documents 1-3, for example). Known processes for production of high-viscosity-index base oils include processes in which stock oils containing natural or synthetic normal paraffins are subjected to lubricating base oil refining by hydrocracking/hydroisomerization (see Patent documents 4-6, for example).

The indexes for evaluating the cold properties of lubricating base oils and lubricating oils are generally the pour point, cloud point and freezing point.

CITATION LIST

Patent Literature

[Patent document 1] Japanese Unexamined Patent Publication HEI No. 4-36391

[Patent document 2] Japanese Unexamined Patent Publication HEI No. 4-68082

[Patent document 3] Japanese Unexamined Patent Publication HEI No. 4-120193

[Patent document 4] Japanese Unexamined Patent Publication No. 2005-154760

[Patent document 5] Japanese Patent Public Inspection No. 2006-502298

[Patent document 6] Japanese Patent Public Inspection No. 2002-503754

SUMMARY OF INVENTION

Technical Problem

However, with demands increasing in recent years for improved low-temperature viscosity characteristics of lubricating oils and also both low-temperature viscosity characteristics and viscosity-temperature characteristics, it has been difficult to completely satisfy such demands even when using lubricating base oils judged to have satisfactory low-temperature performance based on the conventional evaluation standards.

Adding additives to lubricating base oils can result in some improvement in the properties, but this approach has had its own limits. Pour point depressants, in particular, do not exhibit effects proportional to the amounts in which they are added, and reduce shear stability when added in large amounts.

It has also been attempted to optimize the conditions for hydrocracking/hydroisomerization, in refining processes for lubricating base oils that make use of hydrocracking/hydroisomerization as mentioned above, with the aim of increasing the isomerization rate from normal paraffins to isoparaffins and improving the low-temperature viscosity characteristic by lowering the viscosity of the lubricating base oils; however, since the viscosity-temperature characteristic (especially high-temperature viscosity characteristic) and the low-temperature viscosity characteristic are in an inverse relationship, it has been extremely difficult to achieve improvement in both. The fact that the above-mentioned properties such as pour point and freezing point are often unsuitable for evaluating the low-temperature viscosity characteristic of lubricating base oils is another factor that impedes optimization of the hydrocracking/hydroisomerization conditions.

The present invention has been accomplished in light of these circumstances, and its object is to provide a process for production of a lubricating base oil capable of exhibiting high levels of both viscosity-temperature characteristic and low-temperature viscosity characteristic.

Solution to Problem

In order to solve the problems described above, the invention provides a process for production of a lubricating base oil whereby a lubricating base oil is obtained through a first step in which a stock oil containing normal paraffins of $C_{20}$ or more is subjected to isomerization reaction so that the content of the normal paraffins of $C_{20}$ or more is 6-20 wt % based on the total weight of hydrocarbons of $C_{20}$ or more in the obtained reaction product, a second step in which a lube-oil fraction containing hydrocarbons of $C_{20}$ or more is separated from the reaction product of the first step, and a third step in which the lube-oil fraction obtained in the second step is separated into a dewaxed oil and a wax by a solvent dewaxing treatment.

The process for production of the lubricating base oil of the invention, having the construction described above, has an effect which allows production of a lubricating base oil exhibiting high levels of both the viscosity-temperature characteristic and the low-temperature viscosity characteristic, even without complicated setting of the conditions for the isomerization reaction and without modifying the characteristics by addition of additives. The effect of the invention, whereby high levels of both the viscosity-temperature characteristic and the low-temperature viscosity characteristic can be achieved by conducting isomerization reaction to ensure the specific amount of the normal paraffins of $C_{20}$ or more in the obtained reaction product, is a surprising, notable effect compared to production processes of the prior art in which it is considered preferable to have a high isomerization rate from normal paraffins to isoparaffins.

The branched structures of the isoparaffins will differ depending on the process and the production conditions. Presumably, high levels of both the viscosity-temperature characteristic and low-temperature viscosity characteristic can be achieved according to the invention because isomerization reaction that is conducted in such a manner that the obtained reaction product contains a specific amount of the normal paraffins of $C_{20}$ or more, results in formation of a branched structure that is desirable from the viewpoint of both the viscosity-temperature characteristic and low-temperature viscosity characteristic. The present inventors have confirmed that the isoparaffins in the lubricating base oil obtained by the production process of the invention and the isoparaffins obtained by conventional production processes with high isomerization rates have different branched structures.

In the process for production of the lubricating base oil of the invention, all or a portion of the wax separated in the third step is preferably reused as a part of the stock oil for the first step. The production process in this manner can produce an even higher yield of a lubricating base oil exhibiting high levels for both the viscosity-temperature characteristic and the low-temperature viscosity characteristic. Additionally, for example, a satisfactory yield is not obtained even if the wax is reused when isomerization reaction has been conducted in such a manner that the content of the normal paraffins of $C_{20}$ or more is less than 6 wt % in the first step. This is also true if the isomerization reaction is conducted in such a manner that the content of the normal paraffins of $C_{20}$ or more is greater than 20 wt %.

In the process for production of a lubricating base oil of the invention, the stock oil for the first step preferably comprises an Fischer-Tropsch wax. The Fischer-Tropsch wax is a wax obtainable by the Fischer-Tropsch synthesis method, and the Fischer-Tropsch wax may be a commercial product or a wax produced by a known Fischer-Tropsch synthesis method.

The isomerization reaction in the first step of the process for production of a lubricating base oil of the invention is preferably carried out under a hydrogen atmosphere in the presence of a metal catalyst, and the metal catalyst preferably comprises an active metal, which is a metal belonging to Group VIII of the Periodic Table, supported on a support comprising one or more solid acids selected from among amorphous metal oxides. If the isomerization reaction is carried out under a hydrogen atmosphere and in the presence of the aforementioned metal catalyst, it will be possible to more reliably and easily obtain the desired lubricating base oil.

In the process for production of a lubricating base oil of the invention, the lube-oil fraction containing the hydrocarbons of $C_{20}$ or more may be further separated into plural lube-oil fractions with different boiling point ranges in the second step, and the lube-oil fractions may be each independently supplied to the third step. The lube-oil fractions for use here may be 70 pale fraction with a boiling point range of 350-420° C. at ordinary pressure, SAE-10 fraction with a boiling point range of 400-470° C. and SAE-20 fraction with a boiling point range of 450-510° C. In the production process in this manner, the dewaxed oil obtained in the third step can be used directly as the lubricating base oil. The production process allows easier production of a lubricating base oil having specific properties.

The process for production of a lubricating base oil of the invention may further include a fourth step in which the dewaxed oil obtained in the third step is fractionally distilled into plural fractions. The fractions in this case may be 70 pale fraction with a boiling point range of 350-420° C. at ordinary pressure, SAE-10 fraction with a boiling point range of 400-470° C. and SAE-20 distillate with a boiling point range of 450-510° C. The production process in this manner allows easier and more reliable production of a lubricating base oil having specific properties.

The SAE-10 fraction has a viscosity index of 140 or greater and a pour point of no higher than −15° C., and a lubricating base oil obtained via the SAE-10 fraction can be even more suitably used as a lubricating base oil for an automotive lubricating oil or a lubricating oil for industrial machinery.

Advantageous Effects of Invention

According to the invention there is provided a process for production of a lubricating base oil that is capable of exhibiting high levels of both viscosity-temperature characteristic and low-temperature viscosity characteristic.

DESCRIPTION OF EMBODIMENTS

Preferred modes of the invention will now be explained.

The process for production of a lubricating base oil according to this mode yields a lubricating base oil by a first step in which a stock oil containing normal paraffins of $C_{20}$ or more is subjected to isomerization reaction so that the content of the normal paraffins of $C_{20}$ or more is 6-20 wt % based on the total weight of hydrocarbons of $C_{20}$ or more in the obtained reaction product, a second step in which a lube-oil fraction containing hydrocarbons of $C_{20}$ or more is separated from the reaction product of the first step, and a third step in which the lube-oil fraction obtained in the second step is separated into a dewaxed oil and a wax by a solvent dewaxing treatment.

<First Step>

The process for production of a lubricating base oil according to this mode comprises a first step in which a stock oil containing normal paraffins of $C_{20}$ or more is subjected to isomerization reaction so that the content of the normal paraffins of $C_{20}$ or more is 6-20 wt % based on the total weight of hydrocarbons of $C_{20}$ or more in the obtained reaction product.

The stock oil used in the first step is not particularly restricted so long as it is a stock oil containing normal paraffins of $C_{20}$ or more, and it may be a mineral oil or synthetic oil, or a mixture of two or more thereof. Specifically, there may be mentioned a heavy gas oil, vacuum gas oil, lubricating oil raffinate, bright stock, slack wax (crude wax), foot's oil, deoiled wax, paraffin wax, microcrystalline wax, petrolatum, synthetic oil, Fischer-Tropsch synthesis oil, high pour point polyolefins and straight-chain poly-α-olefin wax. Any of these may be used alone or in combinations of two or more. These oils are also preferably subjected to hydrotreating or moderate hydrocracking. Such processing can reduce or eliminate substances that deactivate the hydroisomerization catalyst such as sulfur-containing compounds and nitrogen-containing compounds, and substances that lower the viscosity index of the lubricating base oil such as aromatic hydrocarbons and naphthene-based hydrocarbons.

From the viewpoint of efficient production of the lubricating base oil, the stock oil used in the first step is preferably a hydrocarbon oil containing at least 50 wt %, preferably at least 70 wt % and more preferably at least 90 wt % hydrocarbons with a boiling point of above 230° C. and preferably above 315° C. The stock oil is preferably a wax-containing stock oil that boils in the lubricating oil range specified by ASTM D86 or ASTM D2887. The wax content of the stock oil is preferably between 50 wt % and 100 wt % based on the total weight of the stock oil. The wax content of the stock oil can be measured by a method of analysis such as nuclear magnetic resonance spectroscopy (ASTM D5292), correlative ring analysis (n-d-M) (ASTM D3238) or the solvent method (ASTM D3235).

As examples of wax-containing stock oils, there may be mentioned oils derived from solvent refining methods, such as raffinates, partial solvent dewaxed oils, depitched oils, a vacuum gas oil, coker gas oil, slack wax, foot's oil, Fischer-Tropsch wax and the like, among which a slack wax and Fischer-Tropsch wax are preferred.

A slack wax is typically derived from a hydrocarbon stock oil by solvent or propane dewaxing. A slack wax may contain residual oil, but the residual oil can be removed by deoiling. A foot's oil corresponds to the oil obtained by deoiling of a slack wax.

An Fischer-Tropsch wax is produced by the so-called Fischer-Tropsch synthesis method.

Commercial normal paraffin-containing stock oils are also available. Specifically, there may be mentioned Paraflint 80 (hydrogenated Fischer-Tropsch wax) and Shell MDS Waxy Raffinate (hydrogenated and partially isomerized middle distill from synthetic wax raffinate).

A stock oil from solvent extraction is obtained by feeding a high boiling point petroleum fraction from atmospheric distillation to a vacuum distillation apparatus and subjecting the distillation fraction to solvent extraction. The residue from vacuum distillation may also be depitched. In solvent extraction methods, the aromatic components are dissolved in the extract phase while leaving the more paraffinic components in the raffinate phase. Naphthenes are distributed in the extract phase and raffinate phase. The preferred solvents for solvent extraction are phenol, furfural and N-methylpyrrolidone. By controlling the solvent/oil ratio, extraction temperature and method of contacting the solvent with the distillate to be extracted, it is possible to control the degree of separation between the extract phase and raffinate phase. There may also be used as the stock oil a bottom fraction obtained from a fuel oil hydrocracking apparatus with higher hydrocracking performance.

The isomerization reaction in the first step is not particularly restricted so long as it can produce isoparaffins by isomerization of normal paraffins, but from the viewpoint of efficiently obtaining a lubricating base oil with an excellent viscosity-temperature characteristic and low-temperature viscosity characteristic, it is preferably a reaction conducted under a hydrogen atmosphere in the presence of a metal catalyst (hereinafter referred to as "hydroisomerization reaction").

The metal catalyst used for the hydroisomerization reaction may be, for example, a catalyst having an active metal which is a metal belonging to Group VIII of the Periodic Table supported on a support. Such a metal catalyst will allow more efficient isomerization of the normal paraffins while also further facilitating adjustment of the content of the normal paraffins of $C_{20}$ or more in the obtained reaction product within the range specified above.

The support may be a crystalline or amorphous material, and metal oxide supports are suitable for use. As examples of metal oxide supports there may be mentioned one or more types of support selected from among silica, alumina, silica-alumina, silica-zirconia, alumina-boria and silica-titania. These supports are preferably amorphous, and may be of a single type or a mixture of two or more types. The support is also preferably porous.

As examples of crystalline materials there may be mentioned molecular sieves having 10- or 12-membered ring channels, composed mainly of aluminosilicates (zeolite) or silicoaluminophosphates (SAPO). As specific examples of zeolites there may be mentioned ZSM-22, ZSM-23, ZSM-35, ZSM-48, ZSM-57, ferrierite, ITQ-13, MCM-68, MCM-71 and the like. ECR-42 may be mentioned as an example of an aluminophosphate. As examples of molecular sieves there may be mentioned zeolite beta and MCM-68. Among the above there are preferably used one or more selected from among ZSM-48, ZSM-22 and ZSM-23, with ZSM-48 being particularly preferred. The molecular sieves are preferably hydrogen-type.

As amorphous materials there may be mentioned alumina doped with Group III metals, fluorinated alumina, silica-alumina, fluorinated silica-alumina and the like.

As supports there are preferred bi-componental oxides which are amorphous and acidic, and as examples there may be mentioned the bi-componental oxides cited in the literature (for example, "Metal Oxides and Their Catalytic Functions", Shimizu, T., Kodansha, 1978).

Preferred among these are amorphous composite oxides that contain acidic bi-componental oxides obtained as composites of two oxides of elements selected from among Al, B, Ba, Bi, Cd, Ga, La, Mg, Si, Ti, W, Y, Zn and Zr. The acidic bi-componental oxide composing the support may be any one of the above, or a mixture of two or more thereof. The support may also be composed of the aforementioned acidic bi-componental oxide, or it may be a support obtained by binding the acidic bi-componental oxide with a binder.

The support is preferably one containing at least one acidic bi-componental oxide selected from among an amorphous silica-alumina, amorphous silica-zirconia, amorphous silica-magnesia, amorphous silica-titania, amorphous silica-boria, amorphous alumina-zirconia, amorphous alumina-magnesia, amorphous alumina-titania, amorphous alumina-boria, amorphous zirconia-magnesia, amorphous zirconia-titania, amorphous zirconia-boria, amorphous magnesia-titania, amorphous magnesia-boria and amorphous titania-boria. The acidic bi-componental oxide composing the support may be any one of the above, or a mixture of two or more thereof. The support may also be composed of the aforementioned acidic bi-componental oxide, or it may be a support obtained by binding the acidic bi-componental oxide with a binder. The binder is not particularly restricted so long as it is one commonly used for catalyst preparation, but those selected from among silica, alumina, magnesia, titania, zirconia and clay, or mixtures thereof, are preferred.

The metal catalyst used for the hydroisomerization reaction is preferably a catalyst having an active metal which is a metal belonging to Group VIII of the Periodic Table supported on a support. As specific Group VIII metals there may be mentioned cobalt, nickel, rhodium, palladium, iridium, platinum and the like. Of these, it is preferred to use at least one metal selected from among nickel, palladium and platinum, and such metals may be used alone or in combinations of two or more. From the viewpoint of activity, selectivity and prolongation of activity, it is more preferred to use at least platinum or palladium.

The content of the metal loaded on the support is preferably 0.1-30 wt % based on the total weight of the metal catalyst. Below this lower limit it becomes difficult to impart the prescribed hydrogenation/dehydrogenation function, while above the upper limit the hydrocarbons undergo more lightening by decomposition on the metal, thus tending to lower the yield of the target fraction and leading to increased catalyst cost.

The method for loading the metal on the support may be a known method, such as an impregnation method (equilibrium adsorption method, pore filling method or initial wetting method) or ion-exchange method. The compound containing the metal element component used for this purpose may be a hydrochloride, sulfate, nitrate or complex of the metal. As examples of platinum-containing compounds there may be mentioned platinic chloride, tetraamminedinitroplatinum, diamminedinitroplatinum, tetraamminedichloroplatinum and the like. As palladium-containing compounds there may be mentioned palladium chloride, diamminedinitropalladium, tetramminepalladium chloride, palladium complexes and the like.

The support having the metal loaded by these methods may be directly used as the metal catalyst, but it is preferably used as the metal catalyst after calcination. The calcining conditions are preferably 250° C.-600° C. and more preferably 300-500° C., in an atmosphere containing molecular oxygen. As examples of atmospheres containing molecular oxygen there may be mentioned oxygen gas, oxygen gas diluted with an inert gas such as nitrogen, and air. The calcining time will normally be about 0.5-20 hours. Such calcination will convert the metal element-containing compound loaded on the support into the simple metal or its oxide or other related species, to impart normal paraffin isomerization activity to the obtained catalyst. If the calcining temperature is outside of this range, the catalyst activity and selectivity will tend to be inadequate.

The metal catalyst is preferably one that has been subjected to reduction treatment for about 0.5-5 hours at 250-500° C. and more preferably 300-400° C., in an atmosphere preferably comprising molecular hydrogen, after the calcination mentioned above. Such a step can more reliably impart high activity to the catalyst, for isomerization of the stock oil. Reduction of the catalyst used for the hydroisomerization reaction may occur at the time of the hydroisomerization reaction, but alternatively the catalyst that has been previously subjected to reduction treatment may be used for the hydroisomerization reaction.

The metal catalyst is preferably molded into the prescribed shape. The shape may be, for example, cylindrical, pellet-shaped, spherical, or an irregular cylindrical shape with a three-leaved or four-leaved cross-section. Molding the catalyst composition into such a shape can increase the mechanical strength of the catalyst obtained by calcination, while also improving the handling ability of the catalyst and reducing pressure loss of the reaction fluid during the reaction. A known method may be employed for molding of the metal catalyst.

The isomerization reaction in the first step is carried out so that the content of the normal paraffins of $C_{20}$ or more is 6-20 wt % based on the total weight of hydrocarbons of $C_{20}$ or more in the obtained reaction product. The content of the normal paraffins of $C_{20}$ or more (wt %) referred to here can be determined from the value (wt %) calculated based on the results of compositional analysis of the isomerization reaction product obtained by separation and quantitation by gas chromatography with a nonpolar column and FID (flame ionization detector), using a prescribed temperature program and He as the carrier gas. Then the reaction temperature and other parameters for the hydroisomerization reaction may be appropriately adjusted based on the measured value so that the content of the normal paraffins of $C_{20}$ or more falls within the prescribed range.

When the isomerization reaction is a hydroisomerization reaction, the reaction temperature for the hydroisomerization reaction is preferably 200-450° C., more preferably 220-400° C. and even more preferably 300-380° C. If the reaction temperature is below the lower limit, isomerization of the normal paraffins in the stock oil tends to be difficult to proceed. If the reaction temperature is above the upper limit, on the other hand, decomposition of the stock oil will be increased and the yield of the target base oil will tend to be lowered.

The reaction pressure for the hydroisomerization reaction is preferably 0.1-20 MPa, more preferably 0.5-15 MPa and even more preferably 2-12 MPa. If the reaction pressure is below the lower limit, deterioration of the catalyst will tend to be accelerated due to coke production. If the reaction pressure is above the upper limit, on the other hand, the apparatus construction cost will be increased and it will tend to be more difficult to realize an economical process.

The liquid space velocity of the stock oil with respect to the metal catalyst in the hydroisomerization reaction is preferably 0.01-100 $hr^{-1}$, more preferably 0.1-50 $hr^{-1}$ and even more preferably 0.2-10 $hr^{-1}$. A liquid space velocity below the lower limit will promote excessive decomposition of the stock oil, thus tending to lower the production efficiency for the target base oil. A liquid space velocity exceeding the aforementioned upper limit, on the other hand, will interfere with isomerization of the normal paraffins in the hydrocarbon oil, thus leading to insufficient reduction and removal of the wax components.

The ratio of the hydrogen and stock oil supplied for the hydroisomerization reaction is preferably 100-1000 $Nm^3/m^3$ and more preferably 200-800 $Nm^3/m^3$. If the supply ratio is below this lower limit, such as when the stock oil contains sulfur or nitrogen compounds, hydrogen sulfide and ammonia gas generated by desulfurization and denitrogenation reaction that occur during the isomerization reaction will cause adsorption poisoning of the active metal on the catalyst, thus tending to interfere with the prescribed catalyst performance. If the supply ratio is above the upper limit, on the other hand, a high-spec hydrogen supply apparatus will be required, thus making it more difficult to realize an economical process.

The equipment used to carry out the first step for this embodiment is not particularly restricted and may be known apparatus. The reaction apparatus may be a continuous flow type, a batch type or a semi-batch type, but from the viewpoint of productivity and efficiency it is preferably a continuous flow type. The catalyst layer may be a fixed bed, fluidized bed or stirred bed, but a fixed bed is preferred from the viewpoint of equipment cost. The reaction phase is preferably a gas-liquid mixed phase.

In the process for production of a lubricating base oil according to this embodiment, the hydrocarbon oil of the supplied stock oil may be subjected to hydrotreating or hydrocracking as a pre-processing step prior to the hydroisomerization reaction. Known equipment, catalyst and reaction conditions may be employed. The pre-processing can remove olefin compounds and alcohol compounds, while also prolonging the metal catalyst activity for a longer period of time.

In the process for production of a lubricating base oil according to this embodiment, the oil fraction obtained after hydroisomerization reaction may be further treated by hydrofinishing, for example. The hydrofinishing can usually be carried out by contacting the oil fraction with a supported metal hydrogenation catalyst (such as platinum supported on alumina, for example), in the presence of hydrogen. Such hydrofinishing can improve the color and oxidation stability of the reaction product obtained by the hydroisomerization reaction, and enhance the product quality. The hydrofinishing may be carried out with separate equipment from the hydroisomerization reaction, but alternatively a hydrofinishing catalyst layer may be provided downstream from the catalyst layer of the metal catalyst provided in the reactor for the isomerization reaction, for continuous operation after the hydroisomerization reaction.

Isomerization usually refers to a reaction in which only the molecular structure is altered without change in the number of carbons (molecular weight), while decomposition refers to a reaction involving a reduction in the number of carbons (molecular weight). Even with some decomposition of the hydrocarbons and isomerization products of the stock oil in the isomerization reaction described above, it is only necessary for the number of carbons (molecular weight) of the product to be within a prescribed range which permits the structure of the target base oil, and the decomposition product may even constitute a component of the base oil.

In the process for production of a lubricating base oil according to this embodiment, the reaction product of the isomerization reaction is supplied to the second step. The reaction product referred to here may be the oil fraction obtained from the isomerization reaction as it is, or the oil fraction which has been further subjected to the aforementioned hydrofinishing step or other steps may be supplied to the second step.

<Second Step>

The process for production of a lubricating base oil according to this embodiment comprises a second step in which the lube-oil fraction containing hydrocarbons of $C_{20}$ or more is separated from the reaction product of the first step.

The separation in the second step is preferably carried out in such a manner that the content of isoparaffins of $C_{20}$ or more in the lube-oil fraction is 80 wt % or greater based on the total weight of hydrocarbons of $C_{20}$ or more in the separated lube-oil fraction. The separation is also preferably carried out so that the alcohol compound content in the lube-oil fraction is below the detection limit, i.e. no greater than 0.01 wt %, and the olefin compound content is below the detection limit, i.e. no greater than 0.01 wt %, based on the total weight of the separated lube-oil fraction.

The method of separating the lube-oil fraction in the second step is preferably separation by distillation, from the viewpoint of facilitating separation of a lube-oil fraction satisfying the preferred conditions specified above.

The second step may yield a light fraction composed mainly of up to $C_{19}$ hydrocarbons, and such a light fraction can be suitably used as a fuel base stock. A plurality of light fractions may also be separated by distillation in the second step, and they may be used as a naphtha base stock, (boiling point: lower than approximately 150° C.), kerosene base stock (boiling point: approximately 150-250° C.), and gas oil base stock (boiling point: approximately 250-360° C.) in order of lowest boiling point. According to this mode, high quality fuel oils, i.e. the naphtha base stock rich in isoparaffins, the kerosene base stock having a high smoke point, and the gas oil base stock having a high cetane number, can be obtained.

When a lube-oil fraction containing hydrocarbons of $C_{20}$ or more is separated by distillation in the second step, the distillation conditions are preferably those of an atmospheric distillation process in which the fraction with a boiling point of 360° C. and higher is separated as lube-oil fraction by an atmospheric distillation apparatus. The atmospheric distillation process employed is preferably the same as conventionally used in an ordinary petroleum refining process.

In the process for production of a lubricating base oil according to this embodiment, the lube-oil fraction containing the hydrocarbons of $C_{20}$ or more is further separated into plural of lube-oil fractions with different boiling point ranges, and the lube-oil fractions are each independently supplied to the third step. An example of such a method is one wherein a lube-oil fraction containing hydrocarbons of $C_{20}$ or more is separated from the reaction product by atmospheric distillation, and the lube-oil fraction is further separated into several lube-oil fractions by vacuum fractional distillation.

The lube-oil fractions for use here may be 70 pale fraction with a boiling point range of 350-420° C. at ordinary pressure, SAE-10 fraction with a boiling point range of 400-470° C. or SAE-20 fraction with a boiling point range of 450-510° C., and the lubricating base oils obtained via these fractions can be suitably used as lubricating base oils for an automotive lubricating oil or a lubricating oil for industrial machinery.

Since alcohol compounds and olefin compounds in the lube-oil fraction may impair the oxidation stability and color stability of the lubricating base oil or may interfere with additives in the lubricating oil, the alcohol compound content in the lube-oil fraction is preferably no greater than the detection limit, i.e. no greater than 0.01 wt %, and the olefin compound content is no greater than the detection limit, i.e. no greater than 0.01 wt %. In the first step described above, hydrogenation of the olefin compounds and dehydroxylation of the alcohol compounds proceed simultaneously as the hydroisomerization, thus allowing hydroisomerization reaction to be carried out in an appropriate manner so that the alcohol compounds and olefin compounds in the lube-oil fraction obtained by the second step can be below the detection limits.

<Third Step>

The process for production of a lubricating base oil according to this embodiment comprises a third step in which the lube-oil fraction obtained in the second step is separated into a dewaxed oil and a wax by a solvent dewaxing treatment. The solvent dewaxing treatment is preferred since it allows the wax obtained from the solvent dewaxing treatment to be reutilized as a stock oil for the first step.

A mixture of an aromatic solvent and a ketone-based solvent is preferably used in the solvent dewaxing treatment, and a mixture of an aromatic solvent and a ketone-based solvent in a mixing ratio of 40/60-60/40 (by volume) is preferable, from the viewpoint of selectivity during deposition of the wax and separation thereof by filtration. As aromatic solvents there may be mentioned benzene and toluene, and as ketone-based solvents there may be mentioned MEK (methyl ethyl ketone), MIBK (methyl isobutyl ketone) and acetone. A mixture of toluene and MEK is preferably used from the viewpoint of superior selectivity. The dewaxing conditions are preferably a solvent/oil ratio of 1-6 (volume ratio) and a filtration temperature of between −5 and −45° C. (more preferably between −10 and −40° C.), from the viewpoint of achieving a lubricating base oil pour point of −15° C. or lower.

The dewaxed oil separated out by the third step may be used as it is as the lubricating base oil in the process for production of a lubricating base oil according to this embodiment, but alternatively the dewaxed oil may be further subjected to solvent refining treatment and/or hydrorefining treatment. Such additional treatments are performed to improve the ultraviolet stability or oxidation stability of the obtained lubricating base oil, and may be carried out by methods ordinarily used for lubricating oil refining steps.

In the solvent refining, furfural, phenol, N-methylpyrrolidone or the like are used as a solvent to remove the small amounts of coloring components remaining in the dewaxed oil.

The hydrotreating is carried out for hydrogenation of the olefin compounds and aromatic compounds, and the catalyst therefor is not particularly restricted; for example, there may be used alumina catalysts supporting at least one metal from among Group VIa metals such as molybdenum and at least one metal from among Group VIII metals such as cobalt and nickel, under conditions with a reaction pressure (hydrogen partial pressure) of 7-16 MPa, a mean reaction temperature of 300-390° C. and an LHSV of 0.5-4.0 $hr^{-1}$.

The process for production of a lubricating base oil according to this embodiment may further include a fourth step in which the dewaxed oil obtained in the third step is distilled into a plurality of fractions. The fractional distillation in the fourth step is preferably that by vacuum distillation, and the above plurality of fractions may be, for example, 70 pale fraction with a boiling point range of 350-420° C. at atmospheric pressure, SAE-10 fraction with a boiling point range of 400-470° C. and SAE-20 fraction with a boiling point range of 450-510° C. These fractions may be used as lubricating base oils as it is, or may be used as lubricating base oils via the aforementioned solvent refining treatment and/or hydrorefining treatment. Lubricating base oils produced via the obtained 70 pale fraction, SAE-10 fraction and SAE-20 fraction have the following properties.

70 Pale: A 100° C. dynamic viscosity of 2.5-3.0 $mm^2/s$, a viscosity index of 120 or greater and a pour point of no higher than −30° C.

SAE-10: A 100° C. dynamic viscosity of 3.0-5.5 $mm^2/s$, a viscosity index of 140 or greater and a pour point of no higher than −15° C.

SAE-20: A 40° C. dynamic viscosity of 25-40 $mm^2/s$, a viscosity index of 145 or greater and a pour point of no higher than −20° C.

The viscosity index and pour point are in a reciprocal relationship, with an excessively high viscosity index preventing the pour point from being equal to or lower than the preferred temperature, and an excessively low pour point preventing the viscosity index from being equal to or greater than the preferred value. It is therefore important for the viscosity index and pour point of each lubricating base oil to be in balance.

The wax separated in the third step comprises normal paraffins of $C_{20}$ or more. All or a portion of the wax is preferably reused as a part of the stock oil for the first step. The wax may also be used as stock oil for production of a lubricating base oil by a known process for production. In the production line that includes the first to third steps, the wax separated in the third step is preferably supplied together with the stock oil, to the isomerization reaction in the first step. Thus, the wax separated in the third step of this embodiment is resupplied for production of the lubricating base oil, so that the lubricating base oil is obtained at a high yield. For example, a satisfactory lubricating base oil yield is not obtained even if the wax is reused when isomerization reaction has been conducted in such a manner that the content of the normal paraffins of $C_{20}$ or more is less than 6 wt %, and the viscosity index (VI) of the SAE-10-corresponding lubricating base oil obtained after reuse of the wax may be lowered. Also, when isomerization reaction has been conducted in such a manner that the content of the normal paraffins of $C_{20}$ or more is greater than 20 wt %, the lubricating base oil yield may be lowered and the MRV viscosity, as the index of the low-temperature viscosity characteristic, of the SAE-10-corresponding lubricating base oil obtained after reuse of the wax may be lowered.

In a conventional process for production of a lubricating base oil it is considered preferable to maximize the isomerization rate from normal paraffins to isoparaffins, from the viewpoint of improving the lubricating base oil yield, but according to the process for production of a lubricating base oil of this embodiment, the yield can also be improved by conducting the isomerization reaction so that the content of the normal paraffins of $C_{20}$ or more is a prescribed value.

That is, the process for production of a lubricating base oil according to this embodiment preferably comprises performing the isomerization reaction under the aforementioned prescribed conditions in the first step, and also reusing part or all of the wax separated in the third step as a part of the stock oil. Thus, a lubricating base oil having high levels for both the viscosity-temperature characteristic and the low-temperature viscosity characteristic can be obtained at a high yield.

In the process for production of a lubricating base oil according to this embodiment, it is possible to produce a lubricating base oil that can exhibit high levels for both the viscosity-temperature characteristic and the low-temperature viscosity characteristic. The lubricating base oil obtained by the production process of this embodiment has, in the case of a lubricating base oil obtained from the SAE-10 fraction (hereinafter referred to as "SAE-10-corresponding lubricating base oil"), for example, a viscosity index of 140 or greater, as the index of the viscosity-temperature characteristic, and a MRV viscosity at −40° C. of no greater than 13,000 $mm^2/s$, as the index of the low-temperature viscosity characteristic. Because of exhibiting high levels for both the viscosity-temperature characteristic and the low-temperature viscosity characteristic, the lubricating base oil obtained by this embodiment can be suitably employed as a base oil for the various lubricating oils mentioned below.

The lubricating oil composition including the lubricating base oil produced by the production process of this embodiment may also contain additives if necessary. Such additives are not particularly restricted, and any additives that are commonly employed in the field of lubricating oils may be used. As specific lubricating oil additives there may be mentioned antioxidants, non-ash powders, metal cleaning agents, extreme-pressure agents, anti-wear agents, viscosity index improvers, pour point depressants, friction modifiers, oil agents, corrosion inhibitors, rust-preventive agents, demulsifiers, metal inactivating agents, seal swelling agents, anti-foaming agents, coloring agents, and the like. These additives may be used alone or in combinations of two or more.

The lubricating base oil obtained by the production process of this embodiment has the excellent properties described above and can therefore be suitably employed as a base oil for various lubricating oils. Specific uses of the lubricating base oils include use as a lubricating oil for an internal combustion engine such as a passenger vehicle gasoline engine, two-wheel vehicle gasoline engine, diesel engine, gas engine, gas heat pump engine, ship engine, electric power engine or the like (internal combustion engine lubricating oil), as a lubricating oil for a drive transmission such as an automatic transmission, manual transmission, continuously variable transmission, final reduction gear or the like (drive transmission oil), as a hydraulic oil for a hydraulic power unit such as a damper, construction machine or the like, or as a compressor oil, turbine oil, gear oil, refrigerator oil, metal working oil or the like, and using a lubricating base oil obtained by the production process of this embodiment for these purposes will allow high levels to be achieved for the viscosity-temperature characteristic and low-temperature viscosity characteristic, for each type of lubricating oil.

EXAMPLES

The present invention will now be explained in greater detail based on examples and comparative examples, with the understanding that these examples are in no way limitative on the invention.

Example 1

A lubricating base oil was produced in the following manner in Example 1.

<Preparation of Isomerization Catalyst>

After mixing and kneading silica-alumina (silica/alumina molar ratio: 14) and an alumina binder in a weight ratio of 50:50, the mixture was molded into a cylindrical shape with a diameter of approximately 1.6 mm and a length of approximately 4 mm and then calcined at 550° C. for 3 hours to obtain a support. The support was impregnated with tetrammine-dinitroplatinum for platinum loading. It was then dried at 120° C. for 3 hours and calcined at 400° C. for 3 hours to obtain Catalyst A. The platinum loading weight was 0.8 wt % with respect to the support.

<Step A>

Catalyst A (50 ml) was packed into a hydroisomerization reactor, as a fixed bed flow type reactor, and a Fischer-Tropsch wax (FT wax) having the properties shown in Table 1, obtained by the Fischer-Tropsch (FT) synthesis method, was supplied as a stock oil from the top of the hydroisomerization reactor at a rate of 100 ml/h (LHSV of 2.0 $h^{-1}$), for hydrotreating under the reaction conditions listed in Table 2 under a hydrogen stream.

Specifically, hydrogen was supplied from the top at a hydrogen/oil ratio of 676 NL/L with respect to the FT wax, adjusting the back pressure valve for a constant reactor pressure, pressure at the inlet, of 4.0 MPa, and hydroisomerization was carried out under these conditions. The reaction temperature was 336° C.

The properties of the obtained product oil are listed in Table 2.

<Step B>

The product oil obtained in step A was fractionally distilled with a distillation column at atmospheric pressure, and the fraction with a boiling point of below 360° C. was removed by distillation to obtain the lube-oil fraction with a boiling point of 360° C. or higher from the bottom. The composition of the lube-oil fraction was as follows; a content of normal paraffins of $C_{20}$ or more was 17.9 wt % and a content of isoparaffins of $C_{20}$ or more was 82.1 wt %, with respect to the total weight of hydrocarbons of $C_{20}$ or more in the lube-oil fraction.

<Step C>

The lube-oil fraction obtained in step B was subjected to a solvent dewaxing using a mixed solvent of methyl ethyl ketone (55 vol %) and toluene (45 vol %) under conditions of a solvent/oil ratio of 5 (volume ratio) and a filtration temperature of −25° C., to obtain a dewaxed oil. Whole of the separated wax was recycled as a stock oil for step A. Table 3 shows the solvent dewaxing conditions, the dewaxed oil yield (wt %), the wax yield (wt %) and the SAE-10-corresponding lubricating base oil yield (wt %) in the dewaxed oil. The term "dewaxed oil obtained in step C" used below includes the dewaxed oil obtained by recycling of this wax.

<Vacuum Distillation>

The dewaxed oil obtained in step C was further subjected to vacuum distillation, and upon fractional distillation of 70 pale fraction with a boiling point corresponding to atmospheric distillation of 350-420° C., SAE-10 fraction with a boiling point of 400-470° C. and SAE-20 fraction with a boiling point of 450-510° C., there were obtained a 70 pale-corresponding lubricating base oil, a SAE-10-corresponding lubricating base oil and a SAE-20-corresponding lubricating base oil. The yield for the obtained lubricating base oils (the sum of each of the lubricating base oil yields, with the stock oil FT wax as 100) and the SAE-10 properties are shown in Table 4.

Example 2

A lubricating base oil was produced in the same manner as Example 1, except that the Fischer-Tropsch wax (FT wax) was supplied at a rate of 75 ml/h (LHSV of 1.5 $h^{-1}$) from the top of the hydroisomerization reactor in step A in Example 2.

Comparative Example 1

A lubricating base oil was produced in the same manner as Example 1, except that the Fischer-Tropsch wax (FT wax) was supplied at a rate of 150 ml/h (LHSV of 3.0 $h^{-1}$) from the top of the hydroisomerization reactor in step A in Comparative Example 1.

Comparative Example 2

A lubricating base oil was produced in the same manner as Example 1, except that the Fischer-Tropsch wax (FT wax) was supplied at a rate of 75 ml/h (LHSV of 1.5 $h^{-1}$) from the top of the hydroisomerization reactor in step A, and the reaction temperature was 340° C. in Comparative Example 2.

[Measurement of Dynamic Viscosity]

The SAE-10-corresponding lubricating base oils obtained in Examples 1-2 and Comparative Examples 1-2 were subjected to measurement of the dynamic viscosity at 100° C. according to JIS K2283, "Crude Oil and Petroleum Products—Dynamic Viscosity Test Method and Viscosity Index Calculation Method". The measured dynamic viscosities are shown in Table 4.

[Measurement of Pour Point]

The SAE-10-corresponding lubricating base oils obtained in Examples 1-2 and Comparative Examples 1-2 were subjected to measurement of the pour point according to JIS K2269, "Crude Oil and Petroleum Product Pour Point and Petroleum Product Cloud Point Test Method". The measured pour points are shown in Table 4.

[Measurement of Viscosity Index (VI)]

The SAE-10-corresponding lubricating base oils obtained in Examples 1-2 and Comparative Examples 1-2 were subjected to measurement of the dynamic viscosity at 40° C. and 100° C. according to JIS K2283, "Crude Oil and Petroleum Products—Dynamic Viscosity Test Method and Viscosity Index Calculation Method", and the viscosity indexes (VI) were calculated according to "Viscosity Index Calculation Method" in Section 6. The calculated viscosity indexes (VI) are shown in Table 4.

[Measurement of MRV Viscosity]

The SAE-10-corresponding lubricating base oils obtained in Examples 1-2 and Comparative Examples 1-2 were subjected to measurement of the MRV viscosity according to the methods of JIS K2010, "Automotive Engine Oil Viscosity Classification" and ASTM D4684 "Standard Test Method for Determination of Yield Stress and Apparent Viscosity of Engine Oils at Low Temperature". The measured MRV viscosities are shown in Table 4.

TABLE 1

| | | FT wax |
|---|---|---|
| Density (g/cm$^3$) | | 0.8564 |
| Paraffin content (wt %) | | 94.7 |
| Alcohol content (wt %) | | 2.5 |
| Olefin content (wt %) | | 2.8 |
| Distillation properties | Initial boiling point | 51.0 |
| | 5% Distillation temperature | 116.0 |
| | 10% Distillation temperature | 145.0 |
| | 20% Distillation temperature | 191.0 |
| | 30% Distillation temperature | 233.0 |
| | 40% Distillation temperature | 275.0 |
| | 50% Distillation temperature | 326.0 |
| | 60% Distillation temperature | 373.0 |
| | 70% Distillation temperature | 412.0 |
| | 80% Distillation temperature | 463.0 |
| | 90% Distillation temperature | 531.0 |
| | 95% Distillation temperature | 573.0 |
| | Final boiling point | 654.0 |

TABLE 2

| Step A | | Example 1 | Example 2 | Comp. Example 1 | Comp. Example 2 |
|---|---|---|---|---|---|
| Reaction conditions | Reaction temperature (° C.) | 336 | 336 | 336 | 340 |
| | LHSV ($h^{-1}$) | 2.0 | 1.5 | 3.0 | 1.5 |
| | Hydrogen pressure (MPa) | 4.0 | 4.0 | 4.0 | 4.0 |
| | Hydrogen/oil ratio (NL/L) | 676 | 676 | 676 | 676 |
| Product oil | ≤C19 hydrocarbon content (wt %) | 19 | 23 | 14 | 30 |
| | ≥C20 hydrocarbon content (wt %) | 81 | 77 | 86 | 70 |
| | ≥C20 normal paraffin content (wt %) | 17.9 | 9.1 | 24.0 | 4.0 |

TABLE 3

| Step C | | Example 1 | Example 2 | Comp. Example 1 | Comp. Example 2 |
|---|---|---|---|---|---|
| Solvent dewaxing conditions | Solvent ratio (MEK:toluene) (volume ratio) | 55:45 | 55:45 | 55:45 | 55:45 |
| | Cooling temperature (° C.) | −25 | −25 | −25 | −25 |
| Dewaxed oil yield (wt %) | | 36 | 47 | 22 | 55 |
| Wax yield (wt %) | | 64 | 53 | 78 | 45 |
| SAE-10 yield in dewaxed oil (wt %) | | 40 | 44 | 37 | 46 |

TABLE 4

| | | Example 1 | Example 2 | Comp. Example 1 | Comp. Example 2 |
|---|---|---|---|---|---|
| Lubricating base oil yield (wt %) | | 60.5 | 61.1 | 57.5 | 56.2 |
| SAE-10 properties | Dynamic viscosity (100° C.) ($mm^2/s$) | 4.0 | 4.0 | 4.0 | 4.0 |
| | Pour point (° C.) | −15 | −15 | −15 | −15 |
| | VI | 145 | 141 | 152 | 137 |
| | MRV viscosity (−40° C.) ($mm^2/s$) | 10,300 | 8400 | 14,200 | 5900 |

RESULTS

In Comparative Example 1 and Comparative Example 2 in which contents of normal paraffins of $C_{20}$ or more in the reaction products obtained in step A were outside of the range of the invention, the lubricating base oil yields were lower, while the obtained SAE-10-corresponding lubricating base oils had a lower viscosity index or higher MRV viscosity with potential for yield stress compared to the examples, such that it was not possible to obtain high quality lubricating base oils.

The invention claimed is:

1. A process for production of a lubricating base oil comprising:

(a) subjecting a stock oil containing normal paraffins of $C_{20}$ or more to an isomerization reaction under a hydrogen atmosphere in the presence of a catalyst so that the content of the normal paraffins of $C_{20}$ or more is 6-20 wt. % based on the total weight of hydrocarbons of $C_{20}$ or more in the obtained reaction product, the catalyst comprising an active metal which is a metal belonging to Group VIII of the Periodic Table supported on a support, wherein the support comprises a crystalline or amorphous material, wherein the crystalline material is selected from molecular sieves having 10- or 12-membered ring channels, composed mainly of aluminosilicates (zeolite) or silicoaluminophosphates (SAPO), and wherein the amorphous material is a metal oxide selected from the group consisting of silica, alumina, silica-alumina, silica-zirconia, alumina-boria and silica-titania, (b) separating a lube-oil fraction containing hydrocarbons of $C_{20}$ or more from the obtained reaction product of (a), and (c) separating the lube-oil fraction obtained in (b) into a dewaxed oil and a wax by a solvent dewaxing treatment.

2. The process for production of a lubricating base oil according to claim 1, wherein all or a portion of the wax separated in (c) is reused as a part of the stock oil for the isomerization reaction of (a).

3. The process for production of a lubricating base oil according to claim 1, wherein the stock oil for the isomerization reaction of (a) comprises a Fischer-Tropsch wax.

4. The process for production of a lubricating base oil according to claim 1, wherein the lube-oil fraction containing the hydrocarbons of $C_{20}$ or more is further separated into plural lube-oil fractions with different boiling point ranges in (b), and the lube-oil fractions are each independently separated into a dewaxed oil and a wax by a solvent dewaxing treatment in (c).

5. The process for production of a lubricating base oil according to claim 4, wherein the plural lube-oil fractions include 70 pale fraction with a boiling point range of 350-420° C. at ordinary pressure, SAE-10 fraction with a boiling point range of 400-470° C. and SAE-20 fraction with a boiling point range of 450-510° C.

6. The process for production of a lubricating base oil according to claim 1, further comprising (d) distilling into multiple fractions the dewaxed oil obtained in (c) is distilled into multiple fractions.

7. The process for production of a lubricating base oil according to claim 6, wherein the fractions include 70 pale fraction with a boiling point range of 350-420° C. at ordinary pressure, SAE-10 fraction with a boiling point range of 400-470° C. and SAE-20 fraction with a boiling point range of 450-510° C.

8. The process for production of a lubricating base oil according to claim 5, wherein the SAE-10 fraction has a viscosity index of 140 or greater and a pour point of no higher than −15° C.

* * * * *